United States Patent [19]

Bludis et al.

[11] 4,022,683

[45] May 10, 1977

[54] HYDRODENITROGENATION OF SHALE OIL USING TWO CATALYSTS IN PARALLEL REACTORS

[75] Inventors: Joseph A. Bludis, Pittsburgh; David Lyzinski, Allison Park; Joel D. McKinney; Raynor T. Sebulsky, both of Pittsburgh; Harry C. Stauffer, Cheswick, all of Pa.

[73] Assignee: Gulf Research & Development Company, Pittsburgh, Pa.

[22] Filed: Dec. 22, 1975

[21] Appl. No.: 643,190

[52] U.S. Cl. ..... 208/92; 208/89; 208/211; 208/254 H

[51] Int. Cl.[2] ..... C10G 23/02

[58] Field of Search ..... 208/254 H, 210, 89, 208/211, 92

[56] References Cited

UNITED STATES PATENTS

| | | | |
|---|---|---|---|
| 2,938,857 | 5/1960 | Johnson et al. | 208/254 H |
| 2,983,676 | 5/1961 | Howland | 208/254 H |
| 3,094,480 | 6/1963 | Richardson | 208/254 H |
| 3,306,845 | 2/1967 | Poll | 208/254 H |
| 3,365,391 | 1/1968 | Kelley | 208/254 H |
| 3,481,867 | 12/1969 | Dellert | 208/254 H |
| 3,619,417 | 11/1971 | Sims | 208/254 H |

*Primary Examiner*—Delbert E. Gantz
*Assistant Examiner*—James W. Hellwege

[57] ABSTRACT

A process for hydrodenitrogenation of shale oil comprising fractionating the shale oil into relatively light and heavy fractions, passing the relatively light fraction through a zone containing a catalyst comprising supported molybdenum and Group VIII metal and passing the relatively heavy fraction through a zone containing a catalyst comprising supported tungsten and Group VIII metal.

19 Claims, 1 Drawing Figure

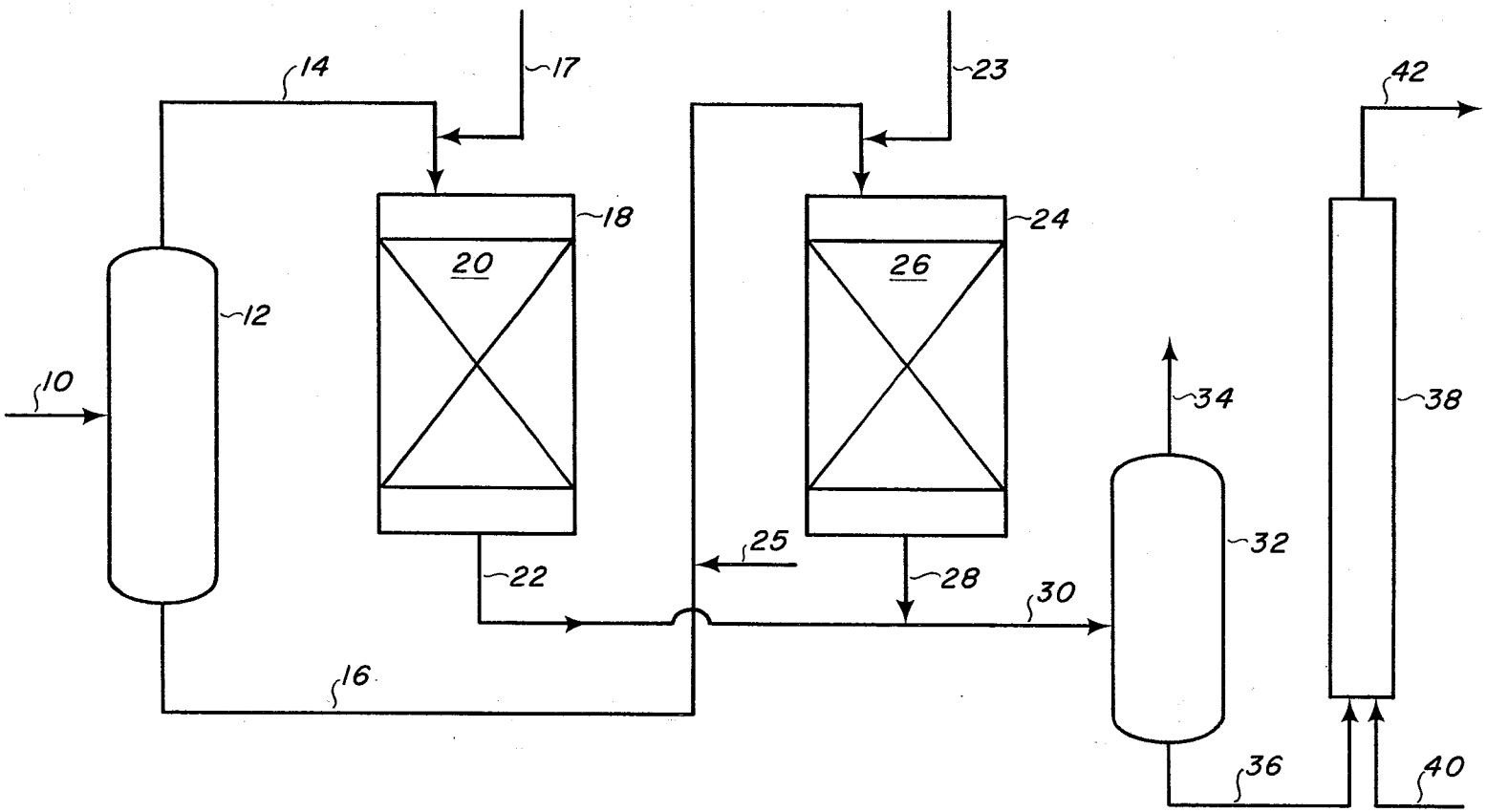
10
12
14
16
17
18
20
22
23
24
26
25
28
30
32
34
36
38
40
42

HYDRODENITROGENATION OF SHALE OIL USING TWO CATALYSTS IN PARALLEL REACTORS

This invention relates to a process for the hydrodenitrogenation of shale oil. More particularly, this invention relates to a process for the conversion of a raw shale oil into a feedstock for a zeolitic cracking riser.

In the preparation of shale oil for use as a feedstock for zeolite riser cracking it is necessary to reduce the nitrogen content of the shale oil to a low level in order to avoid an adverse effect of the nitrogen on the zeolitic cracking operation. In order for shale oil to be rendered suitable as a feedstock for conversion in high yield to naphtha in a zeolitic riser cracking operation, its nitrogen content must be reduced to about 3,000 ppm by weight, generally, or preferably to 2,000 ppm, or less. Processes for zeolitic riser cracking are well known. For example, see U.S. Pat. No. 3,617,512, which is hereby incorporated by reference.

The nitrogen content in shale oil is substantially higher than in petroleum oil and the nitrogen contained in shale oil is much more difficult to reduce to the low level required for converting the oil to a cracking feedstock without concurrent extensive hydrocracking. However, the occurrence of such hydrocracking in preparing a feedstock for a zeolitic cracking process defeats the objective of the hydrotreatment operation because the same cracking can be accomplished in the subsequent zeolitic cracking step in a much more economic manner because hydrogen is neither added to nor consumed in the subsequentzeolite cracking operation. Therefore, the present invention is directed towards a process for the preparation of a shale oil via hydrotreatment for subsequent zeolitic cracking in which the hydrotreatment occurs with improved selectivity towards nitrogen removal over hydrocracking.

Data presented below show that shale oil is unlike petroleum oil in a number of respects. For example, the sulfur content in shale oil tends to be relatively evenly distributed in all fractions and is relatively easily removed from all fractions, while in the case of petroleum oil the sulfur content is relatively more concentrated in the heavier fractions than in the lighter fractions and is more difficult to remove from the heavier fractions than from the lighter fractions. Date presented below show that in shale oil the nitrogen content is more heavily concentrated in the heavier fractions than in the lighter fractions. While the nitrogen content of petroleum oil can be reduced to a low level relatively easily via hydrotreatment, the high nitrogen content of shale oil is very difficult to reduce to a low level. The relatively severe temperature, pressure and space velocity conditions required for the reduction of the nitrogen content of shale oil to a low level generally induce significant hydrocracking.

While a boiling point reduction during hydrodenitrogenation of the shale oil fraction which boils in the residual oil range down to the gas oil boiling range will improve the characteristics of the shale oil as zeolite cracking feedstock, further reduction of the boiling range into the furnace oil or into the naphtha range or lower effectively defeats the objective of the zeolite cracking pretreatment. Any production of furnace oil or gasoline during the hydrotreatment is wasteful because it is not only unnecessarily consumes hydrogen but it also tends to produce saturated naphtha constituents. Saturated naphtha usually exhibits a lower octane value than unsaturated naphtha. In contrast, the furnace oil and naphtha which is produced during zeolitic cracking is produced without hydrogen consumption and the naphtha which is produced tends to be olefinic and aromatic.

The present invention is directed towards a process for the hydrodenitrogenation of shale oil to produce an oil meeting nitrogen specifications of a zeolite cracker feedstock wile preserving as much of the oil as possible in the furnace oil and heavier range, and preferably above the furnace oil boiling range. In accordance with the present invention, this objective is achieved by performing the hydrodenitrogenation process in at least two stages in parallel, each employing a different catalyst. Although the catalysts are different, each catalyst comprises Group VI-B metal and Group VIII metal or metals on a highly porous, non-cracking supporting material. Alumina is the preferred supporting material but other porous non-cracking supports can be employed.

In accordance with the present invention, the amount of Group VI-B metal and of Group VIII metal or metals is generally different in each of the catalysts and a different Group VI-B metal is employed in each catalyst. The catalyst in one of the stages is employed to hydrotreat a relatively light fraction of the oil and the catalyst in the other stage is employed to hydrotreat a relatively heavy fraction of the oil. In the catalyst of the light oil stage, the major Group VI-B metal is molybdenum. Molybdenum is the supported metallic entity present in the greatest amount in this catalyst and the amount of Group VIII metal is smaller than the amount of molybdenum. In the catalyst of the heavy oil stage the major Group VI-B is tungsten instead of molybenum. The tungsten can be, but is not necessarily, the supported catalytic entity present in greatest amount on this catalyst. This catalyst can contain a larger amount of Group VIII metal than the catalyst of the light oil stage.

In the catalyst of the light oil stage, the molybdenum content can generally comprise about 1 to about 15 weight percent of the catalyst, generally, or preferably can comprise about 5 to about 12 weight percent of the catalyst. One or more Group VIII metals can generally comprise about 1 to about 10 weight percent of the catalyst, or can preferably comprise about 1 to about 5 weight percent of the catalyst.

In the second catalyst of the heavy oil stage, the tungsten content can generally comprise about 1 to about 25 weight percent of the catalyst, or preferably can comprise about 15 to about 22 weight percent of the catalyst. The Group VIII metal is advantageously nickel and can generally comprise about 1 to about 25 weight percent of the catalyst, or can preferably comprise about 3 to about 22 weight percent of the catalyst.

The above catalytic metal contents are based on the elemental metal. However, the Group VI-B and Group VIII metal content of both hydrotreating catalysts will generally be present first as metal oxides and will be converted to the metal sulfide state before and/or during the hydrodenitrogenation operation.

Both stages of the hydrodenitrogenation process of this invention generally employ a hydrogen partial pressure of 500 to 5,000 pounds per square inch (35 to 350 kg/cm$^2$) and preferably employ a hydrogen pressure of 1,200 or 1,300 to 1,800 pounds per square inch (84 to 91 to 126 kg/cm$^2$). The hydrogen gas ciculation rate in each stage can be generallybetween 1,000 and 10,000 standard cubic feet per barrel (17.8 and 178 SCM/100L), or preferably can be about 2,500 to 7,000 standard cubic feet per barrel (45 to 126 SCM/100L). The mol ratio of hydrogen to oil can be between about 4:1 and 80:1. Reactor temperatures in each stage can vary between about 650° and 800° F. (343° and 427° C.), generally, and between about 700° and 800° F. (371° and 427° C.), preferably. Reactor temperatures are gradually increased during a catalyst cycle to compensate for catalyst activity aging loss. The liquid hourly space velocity in each reactor can be generally between 0.1 and 5, and preferably between about 0.5 and 2.0 volumes of oil per hour per volume of catalyst. The hydrogen consumption in the tungsten catalyst stage will be between about 300 and 800 SCF/B (5.4 and 14.4 SCM/100L). The hydrogen consumption in the molybdenum catalyst stage will be greater, and generally will be at least 1.5 times greater.

In the high molydenum catalyst stage of this invention, process severity should be sufficiently mild that not more than 20 weight percent of the feed oil to that stage boiling above the naphtha range is hydrocracked to material boiling within or below the naphtha range. Preferably, during the hydrotreatment not more than 5 or 10 weight percent of the feed oil to that stage boiling above 400° F. (204° C.) is converted to material boiling below 400° F. (204° C). Any denitrogenation deficiency resulting from a low severity in the high molybdenum catalyst stage is compensated for in the high tungsten catalyst stage, which is more resistant to hydrocracking, even at higher process severities.

It is shown below that the tungsten catalyst exhibits a relatively high selectivity for hydrodenitrogenation over hydrocracking and that use of the tungsten catalyst permits removal of the most refractory nitrogen present in the shale oil with relatively little hydrocracking to naphtha boiling range material. Therefore, in the tungsten catalyst stage of this invention a higher process severity can be employed so that one or all of the following process conditions can be employed relative to the molybdenum catalyst stage; the liquid hourly space velocity can be lower, the hydrogen pressure can be higher and/or the temperature can be higher. In the tungsten catalyst stage specifically, even at these relatively severe hydrotreating conditions not more than 20 weight percent of the oil supplied to that stage which boils above the naphtha range is hydrocracked to material boiling within or below the naphtha range. Preferably, in the tungsten catalyst stage specifically, not more than 5 to 10 weight percent of the oil charged to that stage boiling above 400° F. (204° C.) is converted to material boiling below 400° F. (204° C.). Because of the high selectivity of the tungsten catalyst to denitrogenation over hydrocracking, the amount of naphtha or material boiling below 400° F. (204° C.) produced specifically in the tungsten catalyst stage will tend to be lower than that produced in the molybdenum catalyst stage, even when the molybdenum catalyst stage is operated under milder conditions of temperature, hydrogen pressure and/or space velocity.

In an advantageous embodiment of the present invention, not more than 20 weight percent, generally, or more than 5 to 10 weight percent, preferably, of the total feed oil to the plural-stage process, one stage employing the molybdenum catalyst and the other stage employing the tungsten catalyst, will be converted from oil boiling above 400° F. (204° C.) or 450° F. (232° C.) to oil boiling below these temperatures.

Table 1 shows the results of tests employing the molybdenum and tungsten catalysts of this invention for single stage hydrodenitrogenation of a full range shale oil.

Separate portions of the feed shale oil whose characteristics are shown in Table 1 were first mildly hydrotreated in an attempt to stabilize the oil before it was subjected to the two more severe hydrotreatment tests of Table 1. The mild hydrotreating conditions included temperatures of 500° and 525° F. (260° to 274° C.), total pressures of 560 and 750 psi (39 to 53 kg/cm²), space velocities of 1 and 2 v/v/hr, a gas circulation rate of about 2,500 SCF/B (45 SCM/100L), with unit hydrogen consumptions of 84 and 208 SCF/B (1.5 to 3.7 SCM/100L). The results of these mild hydrotreatments are not shown in Table 1 because these conditions were so mild that essentially no nitrogen was removed from the oil and the oil was not even stabilized against solids deposition upon standing. These tests showed that hydrotreating conditions of an order of mildness that would ordinarily be capable of stabilizing petroleum oil were not effective for stabilizing shale oil or for removing a significant amount of nitrogen therefrom.

The separate portions of the mildly hydrotreated feed shale oil were then hydrotreated under the more severe conditions shown in Table 1, under which substantial nitrogen removal was accomplished. One portion of the shale oil was hydrotreated with a catalyst comprising sulfided nickel, cobalt and molybdenum supported on alumina, comprising 1 weight percent nickel, 3 weight percent cobalt, and 12 weight percent molybdenum. The other catalyst comprised sulfided nickel and tungsten supported on alumina cmprising 6 weight percent nickel and 19 weight percent tungsten. No fluorine compound was injected. The results of these tests are shown in Table 1.

TABLE 1

HYDROTREATMENT OF FULL RANGE SHALE OIL

| | | Product Inspections | |
|---|---|---|---|
| | Feed Shale Oil | 1% Ni, 3% Co, 12% Mo On Alumina Catalyst | 6% Ni - 19% W On Alumina Catalyst |
| Operating Conditions | | | |
| Temperature: °F. (° C.) | — | 750(399) | 725(385) |
| Total Pressure: psig (kg/cm²) | — | 2173(152) | 2176(152) |
| LHSV: vol/hr/vol | — | 0.5 | 0.5 |
| Gas Circulation: SCF/B (SCM/100L) | — | 4260(76) | 10,000(178) |
| Hydrogen Consumption: SCF/B (SCM/100L) | — | 1218(21.7) | 1235(22) |
| Inspections ($C_5$+ Product) | | | |
| Gravity: °API | 20.7 | 31.5 | 32.7 |
| Sulfur: Wt. % | 0.70 | — | <0.04 |
| Nitrogen: Wt. % | 1.99 | 0.33 | 0.4–0.5 |
| Bromine Number, D1159 | 54 | 5.9 | 5.5 |
| Carbon: Wt. % | 84.52 | 86.77 | 86.35 |
| Hydrogen: Wt. % | 11.14 | 12.84 | 12.94 |
| Oxygen: Wt. % (ppm) | 1.32 | 0.03 | (300) |

TABLE 1-continued

| HYDROTREATMENT OF FULL RANGE SHALE OIL | | Product Inspections | |
|---|---|---|---|
| | Feed Shale Oil | 1% Ni, 3% Co, 12% Mo On Alumina Catalyst | 6% Ni - 19% W On Alumina Catalyst |
| Aniline Point, D611: ° F. | | 165 | 165 |
| Pour Point, D97: ° F. (° C.) | +75(+24) | +70(+21) | +80(+27) |
| Ash: Wt. % | 0.2 | | |
| Naphtha (IBP-375° F.) (IBP-191° C.) | | | |
| Yield: Vol. % Total Liquid Product | 9.74 | 16.7 | 12.2 |
| Gravity: °API | 49.2 | 53.7 | 54.3 |
| Sulfur: Wt. % (ppm) | 0.79 | (650) | (120) |
| Nitrogen: Wt. % | 0.44 | 0.05 | 0.081 |
| Denitrogenation: Wt. % | — | 89 | 82 |
| Bromine Number D1159 | | 8.2 | 0.4 |
| HC Type, ASTM D2789: Vol. % | | | |
| Paraffins | 33.9 | 51.0 | 52.6 |
| Naphthenes | 50.9 | 39.9 | 38.3 |
| Aromatics | 15.2 | 8.6 | 9.1 |
| Distillation, ASTM D86 | | | |
| Over Point: ° F. (° C.) | — | 214(101) | 207(97) |
| End Point: ° F. (° C.) | — | 358(181) | 370(188) |
| 10% Condensed at: ° F. (° C.) | — | 253(123) | 257(125) |
| 30 | — | 275(135) | 280(138) |
| 50 | — | 291(144) | 300(149) |
| 70 | — | 309(154) | 318(159) |
| 90 | — | 333(167) | 340(171) |
| Furnace Oil (375-680° F.) (191-360° C.) | | | |
| Yield: Vol. % Total Liquid Product | 30.85 | 43.7 | 45.0 |
| Gravity: °API | 29.3 | 36.0 | 35.3 |
| Sulfur: Wt. % | 0.63 | 0.05 | 0.054 |
| Nitrogen: Wt. % | 1.47 | 0.23 | 0.48 |
| Denitrogenation: Wt. % | — | 84 | 67 |
| Viscosity, SUS/100° F. (38° C.): Sec. | 40.1 | 36.5 | 37.9 |
| Pour Point, D97: ° F. | +15 | +10 | +10 |
| Bromine Number, D1159: | — | 3.7 | 4.1 |
| Aniline Point, D611: ° F. (° C.) | 87.1(31) | 149(65) | 145(63) |
| Carbon Residue, Rams. D524; Wt. % | — | 0.07 | 0.08 |
| Distillation, ASTM D86 | | | |
| 10% Condensed at: ° F. (° C.) | 446(230) | 441(227) | 451(233) |
| 30 | 492(256) | 475(246) | 486(252) |
| 50 | 538(281) | 514(268) | 529(276) |
| 70 | 580(304) | 559(293) | 574(301) |
| 90 | 626(330) | 613(323) | 617(325) |
| Gas Oil (680-960° F.) (360-516° C.) | | | |
| Yield: Vol. % Total Liquid Product | 32.57 | 24.3 | 32.0 |
| Gravity: °API | 16.3 | 27.2 | 25.7 |
| Sulfur: Wt. % | 0.60 | <0.04 | <0.04 |
| Nitrogen: Wt. % | 2.09 | 0.43 | 0.58 |
| Denitrogenation: Wt. % | — | 79 | 72 |
| Viscosity, SUS/100° F. (38° C.): Sec. | — | 152.7 | 246 |
| Viscosity, SUS/210° F. (99° C.): Sec. | 66.4 | 42.8 | 47.7 |
| Pour Point, D97: ° F. (° C.) | +100(+38) | +95(+35) | +100(+38) |
| Aniline Point, D611: ° F. (° C.) | 126(52) | — | 186.1 |
| Carbon Residue, Rams. D524: Wt. % | 0.91 | 0.08 | 0.09 |
| Distillation, ASTM D1160 | | | |
| 10% Condensed at: ° F. (° C.) | 749(398) | 714(379) | 744(396) |
| 30 | 786(419) | 743(395) | 770(410) |
| 50 | 827(442) | 774(412) | 802(428) |
| 70 | 866(463) | 808(431) | 840(449) |
| 90 | 922(494) | 857(460) | 892(478) |
| Residuum (960° F.+) (516° C.+) | | | |
| Yield: Vol. % Total Liquid Product | 26.84 | 15.3 | 10.8 |
| Gravity: °API | 5.9 | 22.4 | 23.5 |
| Sulfur: Wt. % | 0.64 | 0.09 | 0.12 |
| Nitrogen: Wt. % | 2.84 | 0.68 | 0.79 |
| Denitrogenation: Wt. % | — | 76 | 72 |
| Viscosity, SUS/210° F. (99° C.): Sec. | 5100 | 91.9 | — |
| Viscosity, SUS/250+ F. (121° C.): Sec. | 1159 | 59.7 | 71.0 |
| Pour Point, D97: °F. (° C.) | — | +115(+46) | +115(+46) |
| Ash: Wt. % | 0.64 | 0.02 | 0.02 |
| Carbon Residue, Con.: Wt. % | 20.3 | 2.82 | 1.85 |

The data of Table 1 show that the NiCoMo on alumina catalyst is generally superior for purposes of denitrogenation and pour point reduction as compared to the NiW on alumina catalyst. The data for the two catalysts are comparable in hydrogen consumption even though a higher temperature was utilized with the NiCoMo catalyst test. Table 1 shows both tests consumed about the same amount of hydrogen, 1,218 and 1,235 SCF/B (21.7 and 22 SCM/100L), respectively. Hydrogen economy is an important parameter for commercial purposes. The NiCoMo catalyst produced a combined $C_5$+ product having a nitrogen content of 0.33 weight percent, while the NiW catalyst produced a combined $C_5$+ product having a higher nitrogen content of 0.4–0.5 weight percent. For the test employing the NiCoMo catalyst, the product naphtha, furnace oil, gas oil and residuum fractions experienced percentage denitrogenations of 89, 84, 79 and 76, respectively, while the percentage denitrogenations for the same fractions employing the NiW catalyst were 82, 67, 72 and 72, respectively. These data show that for the lighter fractions, including naphtha and furnace oil, the denitrogenation activity of the NiCoMo catalyst is considerably superior to that of the NiW catalyst. However, for the gas oil fraction the denitrogenation activity for the NiCoMo catalyst has declined from its high level towards that of the NiW catalyst while for the residuum fraction the hydrodenitrogenation activities of the two catalysts are relatively close.

While the data of Table 1 show that when considering the combined product the NiCoMo catalyst has an overall superiority for denitrogenation at a comparable hydrogen consumption level as compared to the NiW catalyst, the data of Table 1 also show that the NiCoMo catalyst exerts its superior denitrogenation activity while incurring the severe disadvantage of concomitantly producing a relatively high naptha yield. As shown in Table 1, the naphtha yield with the NiCoMo catalyst is 16.7 percent, while the naphtha yield with the NiW catalyst is only 12.2 percent. As explained above, when preparing a zeolite cracker feedstock via hydrotreatment not only is any naphtha produced wasteful of hydrogen but also the naphtha produced represents a lower octane value gasoline than naphtha which is produced in the subsequent zeolitic cracking operation which occurs without adding or comsuming hydrogen. Moreover, the naphtha produced in the hydrotreating step must be further hydrotreated before it can be reformed. Table 1 therefore indicates that concomitant production of naphtha imposes a limitation in process severity when hydrotreating shale oil with the high molybdenum catalyst, whereas a similar problem is not apparent with the NiW catalyst.

Table 2 shows data obtained during first stage hydrotreatment of a shale gas oil employing a catalyst comprising sulfided 1 weight percent nickel, 3 weight percent cobalt and 12 weight percent molybdenum on alumina. The shale gas oil was passed over the catalyst at 1.0 LHSV, a total pressure of 1,700 psi (119 kg/cm$^2$), 4,000 SCF/B (72 SCM/100L), and a temperature of 725° F. (385° C.). The hydrogen consumption was about 1,100 SCF/B (19.8 SCM/100L).

TABLE 2

FIRST-STAGE HYDROTREATMENT OF SHALE GAS OIL WITH NiCoMo ON ALUMINA CATALYST

| | Feed Shale Gas Oil | First Stage Product |
|---|---|---|
| Gravity: °API | 13.9 | 26.8 |
| Sulfur: Wt. % | 0.49 | <0.04 |
| Nitrogen: Wt. % | 2.41 | 0.73 |
| Hydrogen: Wt. % | 10.85 | 12.26 |
| Oxygen: ppm | 0.80 | <100 |
| Viscosity, SUS, D2161: ° F/° C | | |
| 100/38 | — | 106.7 |
| 210/99 | 118.4 | 39.3 |
| Pour Point, D97: ° C (° F) | 41(105) | 32(90) |
| Aniline Point, D611: ° C(° F) | 38(101) | 73.5(164.3) |
| Carbon Residue, (R), D524: Wt. % | 1.34 | 0.12 |

TABLE 2-continued

FIRST-STAGE HYDROTREATMENT OF SHALE GAS OIL WITH NiCoMo ON ALUMINA CATALYST

| | Feed Shale Gas Oil | First Stage Product |
|---|---|---|
| Distillation, Vac, D1160: ° C/° F | | |
| End Point | 556/1030 | 516/960 |
| 5% | 403/757 | 251/483 |
| 10% | 429/805 | 300/572 |
| 20% | 452/843 | 356/673 |
| 30% | 465/869 | 379/714 |
| 40% | 476/888 | 393/740 |
| 50% | 485/905 | 407/765 |
| 60% | 493/920 | 423/793 |
| 70% | 504/939 | 438/820 |
| 80% | 515/959 | 454/850 |
| 90% | 532/989 | 477/891 |
| 95% | 549/1021 | 498/928 |

Referring to Table 2, it is seen that the NiCoMo catalyst easily accomplished nearly complete removal of the sulfur content of the feed shale gas oil and accomplished reduction of the nitrogen content from 2.41 to 0.73 weight percent. However, the date of Table 2 show that this level of denitrogenation induced considerable hydrocracking in that about 50 percent of the effluent from the hydrotreatment boiled below the 5 percent distillation point of the feed oil. Moreover, the 5 percent distillation point in the effluent stream was close to the naphtha range.

Table 3 shows the results of two hydrotreating tests wherein the shale gas oil effluent from the first-stage test of Table 2 was passed over a NiW on alumina catalyst comprising 20 weight percent each of nickel and tungsten at a 0.75 LHSV, a temperature of about 738° F. (392° C.) and a total pressure of 1,750 psi (123 kg/cm$^2$). The hydrogen consumption was about 525 SCF/B (37 SCM/100L). Before being passed to the second stage, the first stage effluent was flashed to remove contaminant gases, such as hydrogen sulfide, ammonia and light hydrocarbons, and fresh hydrogen was added to the feed to the second stage. The removal of these materials has the effect of increasing hydrogen partial pressure and reducing space velocity in the second stage. Because of the low sulfur content of the oil, in order to maintain the second stage catalyst in the sulfided state and to maintain the activity of the alumina support of the second stage catalyst, the feed to the second stage was spiked with a hydrogen sulfide precursor in the form of $CS_2$ and with a fluorine precursor in the form of ortho-fluoro-toluene.

TABLE 3

SECOND-STAGE HYDROTREATMENT OF SHALE GAS OIL WITH NiW ON ALUMINA CATALYST

| | First Stage Product | Second Stage Product | Second Stage Product |
|---|---|---|---|
| Gravity: °API | 26.8 | 29.7 | 31.2 |
| Sulfur: Wt. % | <0.04* | — | — |
| Nitrogen: Wt. % | 0.73 | 0.28 | 0.10 |
| Hydrogen: Wt. % | 12.26 | 13.00 | 13.18 |
| Oxygen: ppm | <100 | <100 | <100 |
| Viscosity, SUS, D2161: ° F/° C | | | |
| 100/38 | 106.7 | 83 | 65.8 |
| 210/99 | 39.3 | 37.7 | 35.8 |
| Pour Point, D97: ° C (° F) | 32(+90) | 27(+80) | 29(+85) |
| Aniline Point, D611: ° C(° F) | 73.5(164.3) | 83.3(181.9) | 85.6(186.1) |
| Carbon Residue, (R), D524: Wt. % | 0.12 | 0.07 | 0.05 |
| Distillation, Vac. D1160: ° C/° F | | | |
| End Point | 516/960 | 513/956 | 508/947 |
| 5% | 251/483 | 234/453 | 217/422 |
| 10% | 300/572 | 269/517 | 251/484 |
| 20% | 356/673 | 333/632 | 310/590 |
| 30% | 379/714 | 364/688 | 349/661 |
| 40% | 393/740 | 386/727 | 374/705 |

TABLE 3-continued

| SECOND-STAGE HYDROTREATMENT OF SHALE GAS OIL WITH NiW ON ALUMINA CATALYST | First Stage Product | Second Stage Product | Second Stage Product |
|---|---|---|---|
| 50% | 407/765 | 415/779 | 406/763 |
| 60% | 423/793 | 432/809 | 422/791 |
| 70% | 438/820 | 451/843 | 442/827 |
| 80% | 454/850 | 472/882 | 453/848 |
| 90% | 477/891 | 478/893 | 466/870 |
| 95% | 498/928 | 491/915 | 492/918 |

*This material was spiked with 2,000 ppm sulfur as $CS_2$ and 4 ppm fluorine as ortho-fluoro-toluene.

The data of Table 3 show that in the two NIW on alumina second stage tests employing the shale gas oil effluent stream from the NiCoMo on alumina first stage test of Table 2, the nitrogen content was reduced to 2,800 ppm and 1,000 ppm, respectively, and these low nitrogen levels were achieved with very little further reduction in the boiling range of the stream. It is noted that the sharply inhibited hydrocracking which was exhibited by the second stage occurred in spite of the fact that the second stage operated at a higher temperature, a higher pressure and a lower space velocity than the first stage.

The data of Tables 2 and 3 show that the total product denitrogenation superiority of the NiCoMo catalyst and the reduced hydrocracking characteristic of the NiW catalyst as demonstrated in the data of Table 1 can function interdependently in a multi-stage process of the present invention wherein the feed shale oil is fractionated to produce a relatively light fraction and a relatively heavy fraction, with the relativelylight fraction being passed through the NiCoMo stage and the relatively heavy fraction being passed through a parallel NiW stage. Since the NiW catalyst is relatively more resistant to hydrocracking, the NiW stage can operate under one or more conditions which are relatively more severe than the corresponding condition employed in the NiCoMo stage.

Table 4 shows the results of further tests illustrating second stage hydrotreatment of the oil treated in the tests of Table 3 using a NiW catalyst at various process severities. In these tests the temperatures and space velocities were varied.

TABLE 4

| SECOND-STAGE HYDROTREATMENT OF SHALE GAS OIL WITH NiW ON ALUMINA CATALYST | | | | | | | | |
|---|---|---|---|---|---|---|---|---|
| Feed: Effluent from NiCoMo on alumina first stage | | | | | | | | |
| ° API | | 26.8 | | | | | | |
| Nitrogen: Wt. % | | 0.73 | | | | | | |
| Operating Conditions: | | | | | | | | |
| Total Reactor Pressure | | 1,750 psi (123 kg/cm²) | | | | | | |
| Recycle Gas Rate | | 8,450 SCF/B (152 SCM/100L) | | | | | | |
| Makeup Hydrogen | | 85 volume percent | | | | | | |
| Recycle Gas Hydrogen | | 80 volume percent | | | | | | |
| LHSV: | | 1.0 | 1.0 | 1.0 | 0.5 | 0.75 | 0.75 | 1.0 |
| Catalyst Temperature: | ° C. | 382 | 390 | 402 | 402 | 402 | 392 | 402 |
| | ° F. | 720 | 734 | 755 | 755 | 755 | 738 | 755 |
| Product Nitrogen: Wt. % | | 0.28 | 0.24 | 0.17 | 0.05 | 0.13 | 0.19 | 0.17 |

The data of Table 4 show that a wide range of product nitrogen levels can be recovered from a second stage employing a NiW on alumina second stage catalyst, depending on process severity. All the product nitrogen levels meet zeolitic cracker feed oil specification.

A process scheme for carrying out the present invention is illustrated in the accompanying FIGURE.

As shown in the accompanying FIGURE, feed shale oil passes through line 10 to distillation column 12 from which a relatively light fraction such as light gas oil, with or without some heavy gas oil, is removed overhead through line 14 and from which a relatively heavy bottoms fraction including heavy gas oil and residuum is removed through line 16.

The light fraction together with hydrogen entering through line 17 is charged to the top of reactor 18 containing a fixed bed of NiCoMo on alumina catalyst 20 and is passed downwardly through the catalyst bed and removed from the bottom of the reactor through line 22.

The heavy fraction in line 16 together with hydrogen entering through line 23 and a fluorine precursor compound entering through line 25 is passed to the top of a parallel reactor 24 containing a fixed bed of NiW an alumina catalyst 26 and passed downwardly through the catalyst bed to a reactor discharge line 28.

The reactor effluent streams from lines 22 and 28 are blended in line 30 and passed to a distillation zone 32 from which an overhead stream in line 34 is removed containing hydrogen sulfide, ammonia, naphtha and possibly some furnace oil. A feed oil meeting zeolitic cracking nitrogen specifications is removed from distillation zone 32 through line 36, at least a portion of which is passed to a zeolitic riser 38. Hot, regenerated zeolite catalyst in line 40 enters the bottom of riser 38 and passes upwardly through the riser with the feed oil. The residence time in the riser is less than 5 seconds and an overhead stream is removed from riser 38 through line 42 containing naphtha product, furnace oil and zeolite catalyst.

We claim:

1. A process for the hydrodenitrogenation of shale oil comprising passing a feed shale oil to a distillation zone, removing a relatively low boiling fraction and a relatively high boiling fraction from said distillation zone, passing said low boiling fraction and hydrogen through a zone containing a first catalyst comprising molybdenum as the major supported metallic component in an amount between about 1 and 15 weight percent together with between about 1 to 10 weight percent of Group VIII metal on a non-cracking support, not more than 20 weight percent of said low boiling fraction boiling above the naphtha range being converted to material boiling in or below said naphtha range, passing said high boiling fraction and hydrogen through a zone containing a second catalyst comprising tungsten in an amount between 1 and 25 weight percent together with between about 1 and 25 weight percent of Group VIII metal on a non-cracking supporting material, the temperature in said zones being between about 650° and 800° F. and the hydrogen pressure in said zones between about 500 and 5,000 psi.

2. The process of claim 1 including blending the effluent from the zone containing said first catalyst with the effluent from the zone containing said second catalyst.

3. The process of claim 1 wherein at least a portion of the effluent from said process boiling above the naphtha range is passed to a zeolite riser cracking zone.

4. The process of claim 1 wherein the combined effluent from the zone containing said first catalyst and the zone containing said second catalyst boiling above the naphtha range contains less than 3,000 ppm of nitrogen.

5. The process of claim 1 wherein the combined effluent from the zone containing said first catalyst and the zone containing said second catalyst boiling above the naphtha range contains less than 2,000 ppm of nitrogen.

6. The process of claim 1 wherein less than 10 percent of the feed oil boiling above 400° F. is converted to oil boiling below 400° F.

7. The process of claim 1 wherein a fluorine precursor compound is added to the zone containing said second catalyst.

8. The process of claim 1 wherein said first catalyst comprises between about 5 and 12 weight percent of molybdenum and between about 1 and 5 weight percent of Group VIII metal.

9. The process of claim 1 wherein said second catalyst comprises between about 15 and 22 weight percent of tungsten and between about 3 and 22 weight percent of Group VIII metal.

10. The process of claim 1 wherein said first catalyst support comprises alumina.

11. The process of claim 1 wherein said first catalyst comprises cobalt and molybdenum on alumina, and the oil and hydrogen are passed downwardly through a fixed bed of said catalyst.

12. The process of claim 1 wherein said second catalyst support comprises alumina.

13. The process of claim 1 wherein said second catalyst comprises nickel and tungsten on alumina, and the oil and hydrogen are passed downwardly through a fixed bed of said catalyst.

14. The process of claim 1 wherein the hydrogen consumption in the zone containing said second catalyst is between about 300 and 800 SCF/B, and the hydrogen consumption is the zone containing said first catalyst is greater.

15. The process of claim 1 wherein the hydrogen consumption in the zone containing said second catalyst is between about 300 and 800 SCF/B, and the hydrogen consumption in the zone containing said first catalyst is at least 1.5 times greater.

16. The process of claim 1 wherein the hydrogen pressure in the zone containing said second catalyst is higher than the hydrogen pressure in the zone containing said first catalyst.

17. The process of claim 1 wherein the temperature in the zone containing said second catalyst is higher than the temperature in the zone containing said first catalyst.

18. The process of claim 1 wherein the liquid hourly space velocity in the zone containing said second catalyst is lower than the space velocity in the zone containing said first catalyst.

19. The process of claim 1 wherein the hydrogen pressure in said zones is between about 1,300 and 1,800 psi.

* * * * *